United States Patent [19]

Ito

[11] 4,032,056

[45] June 28, 1977

[54] ROLL FEEDER DEVICE FOR PRESS WORKS

[76] Inventor: Sakumatsu Ito, 112 Daijoujijimonyama-cho, Kaga, Ichikawa, Japan

[22] Filed: Sept. 23, 1975

[21] Appl. No.: 616,014

[52] U.S. Cl. ..... 226/154; 226/156; 226/181

[51] Int. Cl.[2] ..... B65H 17/22

[58] Field of Search ..... 226/152, 154, 155, 156, 226/134, 181; 74/122, 567, 569

[56] References Cited

UNITED STATES PATENTS

| | | | |
|---|---|---|---|
| 1,708,540 | 4/1929 | Greenbaum | 226/154 X |
| 3,456,859 | 7/1969 | Beituss | 226/156 X |
| 3,483,772 | 12/1969 | D'Amato | 226/156 X |
| 3,493,159 | 2/1970 | Balunas | 226/154 X |

*Primary Examiner*—Richard A. Schacher
*Attorney, Agent, or Firm*—Cushman, Darby & Cushman

[57] ABSTRACT

A roll feeder device for press works utilizing a barrel cam drive system having a sinusoidally grooved portion engageable with rollers secured to an indexing plate which transmits the rotational motion of the main drive shaft of the press to the feed rolls so as to coordinate feeding of material to movement of the press in such a manner that the material is fed with a substantially constant velocity during the material feed portion of the cycle. A braking system is provided in which the driven feed roll is moved away from the material being fed, in response to a camming action of a lever mechanism coordinated to the movement of the press through rotation of the main drive shaft. The roll feed mechanism being separable from the motion transmission mechanism by means of an interconnecting roll driving shaft and feed roll shaft in which a collar and span ring are fitted within a large hollow cylindrical portion of the roll driving shaft and the end of the driving feed roll shaft inserted therewithin, with a mandrel inserted through the opposite end of the roll driving shaft and biased against the collar so as to detachably join the roll driving shaft and the driving feed roll shaft.

4 Claims, 11 Drawing Figures

ROLL FEEDER DEVICE FOR PRESS WORKS

BACKGROUND OF THE INVENTION

1. Field of the Invention

This invention relates to an automatic material feeding system in a press, and more particularly to a roll feeder adopting a barrel cam drive system suited for use as an automatic material feeding device in a high-speed press.

2. Prior Art

As is well known, a roll feeder comprises essentially a driving feed roll and a driven feed roll disposed in opposition and pressed contact with said driving feed roll so as to be driven thereby, and the driving roll is turned intermittently while maintaining a constant timed relation with reciprocation of the cope or forming member of the press, thereby to effect power feed of the work held and worked between both rolls. The most important requisite in such power feed is to minimize the error between the schemed feed distance and the actual feed distance, that is to say, to maintain the set feed accuracy constantly. Such maintenance of feed accuracy won't be ensured unless smooth and accurate transmission of motion from the press body to the main driving feed roll is provided. In other words, it is essential that the motion transmission mechanism between the crank shaft which reciprocates the press ram and the roll feeder be designed and worked such that no excess or undue stress or force will be built up in the structural mechanisms. In the conventional roll feeder devices, a crank motion mechanism has been employed as the motion transmission mechanism. For instance, an eccentric disc is mounted at an end of the crank shaft designed to effect up and down movement of the press ram, while a one-way ratchet mechanism is operatively associated with the driving feed roll of the roll feeder, with the eccentric shaft of said eccentric disc being coupled to said one-way ratchet mechanism by a connecting rod, so that one rotation of the crank shaft will provide one reciprocation of the press ram while letting the driving feed roll turn intermittently through said connecting rod and one-way ratchet mechanism during each rotation of the crank shaft, thereby to effect automatic intermittent feed of the work.

In this case, it is to be noted that transmission of motion from the crank shaft of the press to the driving feed roll of the roll feeder has a nature that it tends to constantly change the rotating speed of the driving feed roll during the entire process of rotation notwithstanding the fact that the crank shaft of the press rotates at constant speed. Further, since the time of motion of the press ram and the time of turn of the driving feed roll, have therebetween a difference of 90° in terms of the angle of turn of the crank shaft, when the press ram is at its upper dead point the driving feed roll is turned at the highest speed in the entire process of rotation at the time when the press ram begins its descent from the upper dead point. Also, when the angle of turn of the crank shaft reaches 90°, that is, when the press ram just begins its stroke, the eccentric disc and the connecting rod will now have the angular difference of 180°, so that although the driving feed roll ceases to rotate, acceleration of the driving feed roll at that time is maximized.

In such type of motion transmission mechanism, it is hard to maintain constant feed accuracy, and it is even more difficult to ensure constant feed accuracy while maintaining high-speed feed of the work. This is mostly due to the following reason. That is, if the rotating speed of the driving feed roll is changed during its process of rotation, it can cause itself inaccurate transmission of the friction-based motion from the driving and driven feed rolls to the material to be fed, and particularly when the driving and driven feed rolls are stopped, the maximum acceleration produced at that moment gives a large inertia to both said driving and driven feed rolls and the material to be fed, and this could cause sliding between them and thus badly affect feed accuracy, resulting in producing an error between the schemed feed distance and the actual feed distance to make it impossible to maintain the constant feed accuracy. This is witnessed particularly when the press speed is increased, that is, when the work is fed at high speed for effecting high-speed work.

Thus, the conventional roll feeder employing such crank motion mechanism in the motion transmission mechanism can not be safely adapated to an automatic material feeding system for a press which is basically designed for high-speed works. Such low feed accuracy leads immediately to reduced utilization rate of the material. Further, in the systems employing such a motion transmission mechanism, there are involved many joints used for connecting. For instance, the eccentric disc and connecting rod, the connecting rod and one-way ratchet mechanism, etc., and such joints have a possibility to become loose in the course of use and looseness of such joints causes even lower feed accuracy. Also, a large number of such joints gives a greater opportunity of causing backlash and consequent generation of noise and shaking, resulting generally in reduced working efficiency.

SUMMARY OF THE INVENTION

The present invention has been devised for overcoming the above-said problems of the conventional devices, and more specifically, there is provided according to the present invention a roll feeder device adopting a barrel cam drive system for use in press works, said feeder device comprising basically a driving feed roll and a driven feed roll disposed in opposition and pressed contact with said driving roll so as to be rotated by said driving roll, wherein the mechanism for transmitting motion from the press body to said driving feed roll is a barrel cam turned by the rotative force of the crank shaft in the press body and an index plate arranged to be turned intermittently by said barrel cam.

Thus, a primary object of the present invention is to provide a roll feeder device which is capable of maintaining constant feed accuracy by employment of a positive-motion barrel cam having smooth turning motion characteristic, or more specifically, a sine curve motion characteristic, whereby constant feed accuracy can be maintained at a high degree even in high speed operations.

Another object of the present invention is to provide a roll feeder device of the type described which is capable of improving the utilization rate of material while minimizing noise and vibration, thereby realizing marked improvement of workability.

Still another object of the present invention is to provide a roll feeder device of the type recited, further characterized in that a hollow cylinder is used for the driven feed roll axially supported by the roller holders backed up by spring means in the direction of the driving feed roll, and cone-shaped brakes arranged adjustable in their braking capacity are provided in the inside of said hollow cylinder so as to prevent inertia of the driven roll when the feed is stopped, and there are also provided means for moving said roll holders downwardly or upwardly at the time of start or stoppage of the material feed, whereby when the feed is stopped, said driving feed roll and driven feed roll are separated from each other to bring the material into a free state but the material is set at a regulated position by a pilot punch immediately after completion of feed, thereby allowing even higher feed accuracy.

It is still another object of the present invention to provide a roll feeder device in which a roll feed mechanism consisting of the driving and driven feed rolls is detachably combined with a motion transmitting mechanism comprising a barrel cam and an index plate to permit selective use of the roll feed mechanisms with various different diameters, thereby allowing adjustment of the material feed pitch in conformity to the press working requirement.

A further object of the present invention is to provide a roll feeder device in which the driving feed roll is not fixedly set but rotatably fitted on the driving roll shaft which is turned intermittently by the motion transmission mechanism including a barrel cam and an index plate, allowing transmission of the rotational torque from the driving feed roll shaft to the driving roll through a change gear unit, and wherein the change gears are used selectively, that is, the change gear ratios are changed suitable to allow adjustment of the material feed pitch over a wide range according to the press working pattern desired thereby maintaining constant feed accuracy at high level.

BRIEF DESCRIPTION OF THE DRAWINGS

The accompanying drawings illustrate some preferred embodiments of the present invention, wherein.

DETAILED DESCRIPTION OF THE PREFERRED EMBODIMENTS

The present invention is hereafter described in detail by way of its preferred embodiments with reference to the accompanying drawings.

Figure 1:
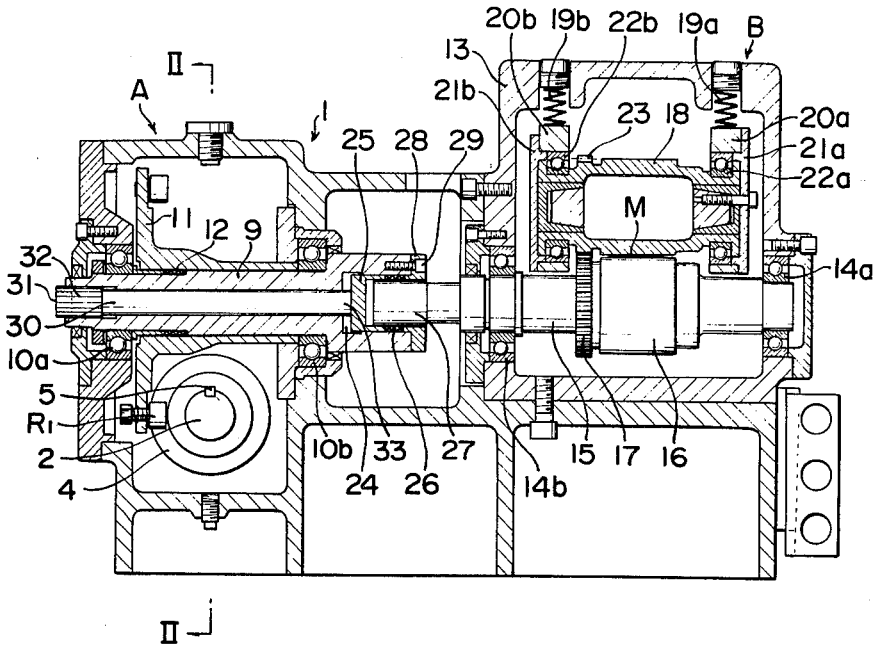
FIG. 1 is a longitudinal sectional view of a first embodiment of the present invention.
Figure 2:
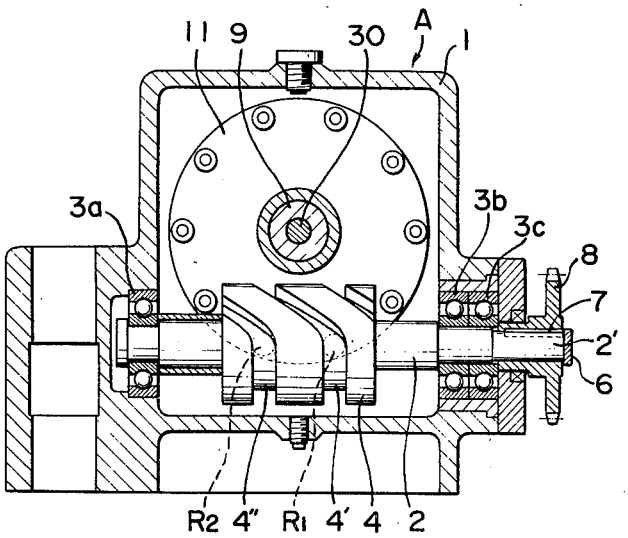
FIG. 2 is a sectional view taken along line 2—2 of FIG. 1, showing particularly the relationship between the barrel cam and the index plate.
Figure 4:
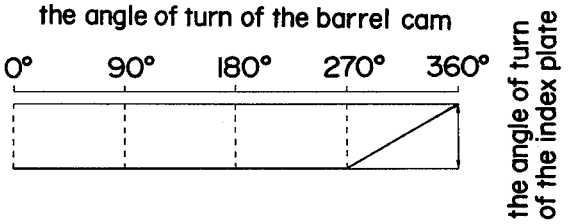
FIG. 4 is a diagram illustrating the relationship between the angle of turn of the barrel cam and the angle of turn of the index plate (or the driving feed roll) in the first embodiment of the present invention in a case where arrangement is made such that the barrel cam makes one rotation with one rotation of the crank shaft of the press.
Figure 5:
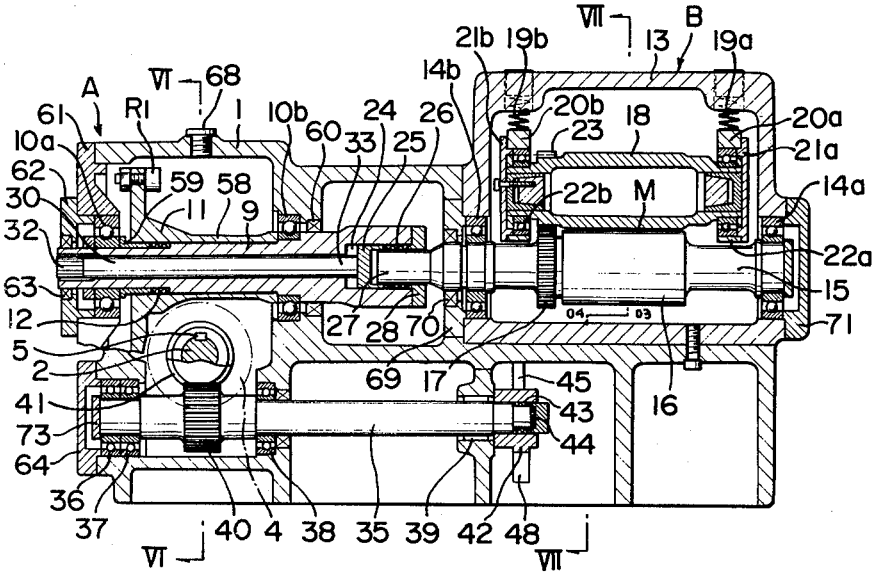
FIG. 5 is a sectional view of a second embodiment of the present invention taken along line $5\text{-}0_f\text{-}0_2\text{-}5$ of FIG. 6.
Figure 6:
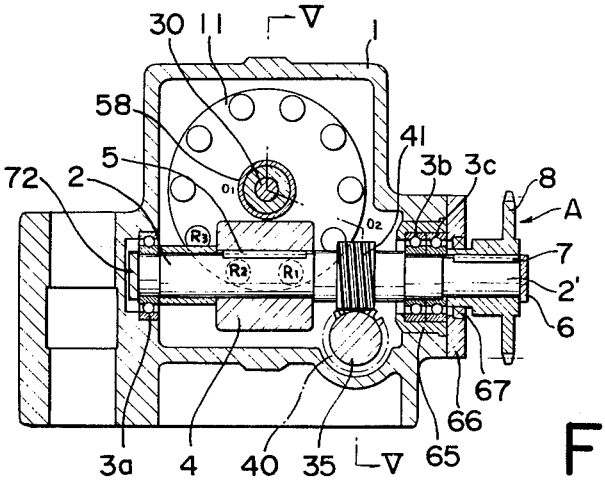
FIG. 6 is a sectional view taken along the line 6—6 of FIG. 5.

Referring frist to the embodiment illustrated in FIGS. 1 and 4, there is shown a roll feeder device comprising a motion transmission mechanism A, designed for transmitting the motion of the crank shaft of the press to the driving feed roll, and a roll feed mechanism B which is controlled in operation by said motion transmission mechanism A. First the motion transmission mechanism A is described in detail. It will be seen that the main driving shaft 2 is rotatably journaled by bearings 3*a*, 3*b*, 3*c* in a casing 1 containing lubricant therein, and a barrel cam 4 formed with a cam groove or grooves is secured at a predetermined position of said main driving shaft 2 by means of a key 5. At the end 2′ of the shaft 2 projecting out from the casing 1 is secured a sprocket 8 by means of a holding fitment 6 and a key 7. It will be also seen that a hollow roll driving shaft 9 supported by bearings, 10*a*, 10*b* is provided traversing said main driving shaft 2 perpendicularly, and an index plate 11 is mounted on said hollow shaft 9 through a span ring 12. Along the peripheral edge of said index plate 11 are equidistantly arranged a plurality of rollers R1, R2, . . . (10 rollers in the shown embodiment). These rollers R1, R2, . . . are so arranged as to engage with the cam grooves in said barrel cam 4 so as to transmit the turning torque of said barrel cam to the index plate 11 through said rollers R1, R2, . . . In the embodiment shown here, the barrel cam 4 is provided with double cam grooves 4′ and 4″ so that at least two of the rollers R1, R2, . . . are always engaged with the cam grooves. Also, each of said cam grooves 4′, 4″ is so configured that the barrel cam 4 will make a rotation with every full rotation of the crank shaft of the press, that is, the 0° – 270° section of the whole circumference forms a rectilinear groove and the 270° – 360° section forms a sine-curved groove. Such formation is of course merely one example of the structural arrangement in the principle of the present invention; the barrel cam 4 may be provided with only one cam groove so that at least one of the rollers R1, R2, . . . will be always kept in engagement with the cam groove. In either case, when arrangement is made such that the barrel cam 4 will make one rotation with one rotation of the crank shaft of the press, it is desirable that the sine-curved groove is provided over a 60° – 90° section of the entire circumference of the barrel cam. When arrangement is made such that the barrel cam 4 will make a half turn or a fraction-of-an-integer turn with one rotation of the crank shaft to let the index plate 11 turn through every division of rollers along the circumference merely by the half or a-fraction-of-an-integer turn of the barrel cam 4, both the rectilinear and sine-curved grooves are formed within the range of the half or a fraction of an integer of the whole circumference of the barrel cam. In either case, the number and configuration of the cam grooves formed on the barrel cam 4 are determined suitably to allow smooth since curve motion of the index plate 11, which is a driven wheel, while considering various other press working conditions, particularly the material feed pitch.

Next will be described the roll feed mechanism B which is an independent unit from the above-described motion transmission mechanism A. It will be seen that the driving feed roll shaft 15 is rotatably journaled at both ends of a unit casing 13 by means of bearings 14*a*, 14*b*. A driving feed roll 16 with a predetermined diameter and a gear 17 are mounted on said driving roll shaft 15 for rotation therewith. Above and in opposition to said driving feed roll 16 is disposed a driven feed roll 18. Disposed at both ends in the inside of said unit casing 13 are roll holders 20*a* and 20*b* which are biased downwardly by springs 19*a* and 19*b*, respectively. Each of said roll holders 20*a*, 20*b* contains a bearing 22*a*, 22*b* held in position by a cap 21*a*, 21*b*. The bearings 22*a* and 22*b* are arranged to rotatably support said driven feed roll 18. The driven feed roll 18 itself is axially mounted with a gear 23 which is meshed with said gear 17 so that the rotative force of the driving feed roll 16 is transmitted to the driven feed roll 18 through said gears 17 and 23.

Transmission of the driving force from the motion transmission mechanism A to the driving feed roll 16 in the roll feed mechanism B can be accomplished by merely joining the roll driving shaft 9 and the driving feed roll shaft 15 by a known shaft coupling, and no other additive elements are required for attaining the primary object of the present invention. But the following arrangements are recommended for accomplishing the other objects of the present invention, that is, for allowing exchange of various sizes of roll feed mechanism B with relation to the motion transmission mechanism A to permit adjustment of the material feed pitch in accordance with the press working requirements. That is, the portion of said hollow roll driving shaft 9 located closer to the unit casing 13 is enlarged to form a large-diameter hollow portion 24 and, with a collar 25 and a span ring 26 being fitted therein, a connecting portion 27 formed integral with said driving feed roll shaft 15 is inserted into said enlarged hollow portion 24 and securely held in position by member 28 and a set screw 29. Also, a mandrel 30 is inserted from the other end of said hollow roll driving shaft 9 and screw-fitted by a lock nut 32 formed with a fastening socket hole 31, and the end 33 of said mandrel 30 is press set against collar 25 to thereby detachably join the driving feed roll shaft 15 and the roll driving shaft 9. In this way, the roll feed mechanism B, which is an independent unit, can be exchanged by an external operation with relation to the motion transmission mechanism A.

Figure 3:
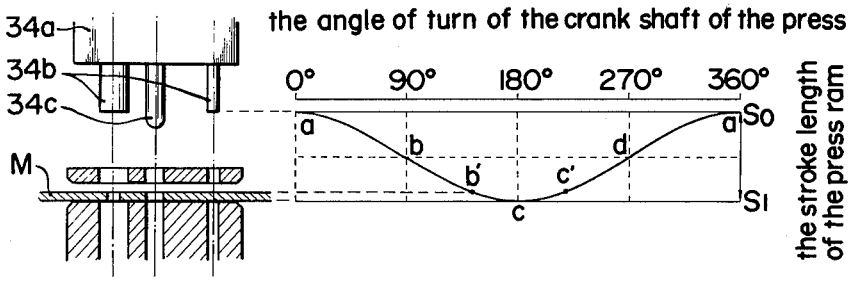
FIG. 3 is a diagram illustrating the relationship between the angle of turn of the crank shaft of the press and advancement of the press ram of the first embodiment of the present invention.

Operation of the above-described embodiment will now be described with reference to the diagram of FIG. 3 showing the relationship between the angle of turn of the crank shaft of the press and advancement of the press ram or the cope and the diagram of FIG. 4 showing the relationship between the angle of turn of the barrel cam 4 and the angle of turn of the index plate 11. If the press is started from the position where the angle of turn of the crank shaft is 0°, that is, where the end face of the stroke punch 34*b* set to the cope 34*a* mounted on th press ram, is at the upper dead point $S_0$ of the stroke, the crank shaft turns from 0° to 90° and to 180°, that is, the cope advances from *a* to *b* and then to *c* until finally reaching the lower dead point $S_1$. In this process, as is self-evident, the stroke advances and completes. To put it more definitely, when the crank shaft is turning from 0° to 90°, that is, when the cope is advancing from *a* to *b*, the press working stroke is not yet started, and when the crank shaft is turning from 90° to 180°, that is, when the cope is advancing from *b* to *c*, the press stroke advances and completes. It is to be also noted that, except for certain specific cases, work is started from the moment when the cope is positioned close to the point *c*, and is completed upon arriving at said point *c*. As regards the point punch 34*c*, the stroke advances from the position *b* where the end face of the pilot punch 34*c* contacts the upper surface of the material M and completes at the point *c*.

Thereafter, the crank shaft further turns from 180° to 270° and to 360° while the cope advances through one stroke to reach the upper dead point $S_0$ to repeat thereafter the same behavior as said above. Thus, automatic feed of the material M with relation to the movement of the cope 34*a*, if considered rather abstractly, may be allowed at any time during the period when the pilot punch 34*c* and stroke punch 34*b* are not contacted, at any part thereof, with the upper surface of the material M.

In the case where a conventional crank motion mechanism is employed, as the motion transmission mechanism for turning the driving feed roll 16, the time allowed for the feed, if expressed by the angle of turn of the crank shaft, is between 270°, 360°(0°) and 90°, and if expressed by the stroke curve of the press ram, between *d*, *a* and *b*. This means that the material feed starting time is restricted to the position *d* and feed stopping time to the position *b*. These two positions *d* and *b* are the positions where the press ram moved up and down by the crank shaft gains its maximum speed and also the positions where the maximum acceleration is given to the driven feed rolls 16 and 18 when conventional power transmission mechanisms, as described above are utilized. Therefore, at the time of start or stoppage of the feed, a large inertia is given to the driving and driven feed rolls 16 and 18 as well as to the material M to be fed, so that slippage could be caused between said rolls 16 and 18 and the material M to badly affect the feed accuracy. This is observed conspicuously in high speed feed.

The feeder device according to the present invention is however perfectly free of the above said problems. According to the present invention, a suitable sprocket or like means is mounted at an end of the crank shaft of the press, and also an endless conveyor belt such as a chain belt is passed between said sprocket, not shown, and another sprocket 8 mounted on the main driving shaft of the motion transmission mechanism A. In the case of the instant embodiment, since arrangement is made such that the barrel cam 4 will make a rotation with one rotation of the crank shaft of the press, both sprockets are selected to be the same diameter so that no change of speed is effected.

Also, proper timing is accomplished such that when the crank shaft of the press is turning in the range of 0° – 90° – 180° – 270°the rollers R1, R2, . . . engaged in the cam grooves on the barrel cam 4 will be guided in the rectilinear groove section spanning the angular scope of 270°, and that when said crank shaft is turning in the range of 270° – 360°, said rollers engaged in the cam grooves on said barrel cam 4 will be guided in the sine-curved groove section that spans this range of 90°. Of course, the range of the sine-curved groove section need not be 90°, but as aforementioned, it is desirable that such range is 60° to 90°, and even if such range is set at 90°, its relation with the angle of turn of the crank shaft of the press is not restricted to the one described above. As feed is permitted at any time during the period when no part of the press ram or cope is in contact with the upper surface of the material M, setting may be made at any section in the range of *d-a-b* of the stroke curve of the press ram. Obviously, if punch 34*c* had its lower end at the same level as the lower end of punch 34*b* the range of degrees for permitting feeding of material M would be increased to 270°, defined by the range *c'* -*d-a-b-b'*of the stroke curve of the press ram. It should be noted however that the above said arrangement is but an example cited for convenience of explanation.

Under the illustrated conditions of the first described embodiment, the crank shaft of the press turns from 0° to 90° and to 180° while the cope 34*a* of the press advances from *a* to *b* to *b'*to *c*, and during the time when said cope is making its final stroke through the section of *b'-c* and when it advances reversely from *c* to *c'*to *d* with the crank shaft turning in the section of 180° – 270°, the main driving shaft 2 and barrel cam 4 are also forced to turn from 0° to 270° by the equal-speed rotative force of the crank shaft through the chain (not shown) and sprocket 8, but at this time, since at least two of the rollers R1, R2, . . . on the index plate 11 are guided in the rectilinear groove section on the barrel cam 4, both the index plate 11 and the roll driving shaft 9 remain non-rotative and hence the driving feed roll 16 is also non-rotative, so that no feed of the material M is made. But when the crank shaft of the press is turning through the section 270° – 360°and the cope 34*a* of the press is advancing from *d* to *a*, the rollers R1, R2 on the index plate 11 are guided in the sine-curved groove section on the barrel cam 4, so that the index plate 11 is allowed to turn intermittently only through each equally divided section of the rollers R1, R2, . . . , forcing the driving feed roll 16 and driven feed roll 18 to correspondingly turn through the roll driving shaft 9 and driving feed roll shaft 15 to feed the material M held pressedly between said both rolls. In this way, the feed of the material is completed quickly during the time when the crank shaft of the press is turning from 270° to 360°, and thereafter the same behavior is repeated. Thus, if the automatic intermittent feed mechanism comprising the barrel cam 4 and index plate 11 is employed as means for transmitting motion from the press body to the driving feed roll 16, the following important advantages are obtained:

1. When the rollers R1, R2, . . . on the index plate 11 are guided in the sine-curved groove section on said barrel cam 4 and the index plate 11 is being turned, transmission of motion is effected in accordance with a pattern of a sine curve and hence its turning motion is of constant speed and no instantaneous force transmission is made, so that the driving feed roll 16 rotates smoothly at constant speed.

2. As self-evident from the explanation given in (1) above, no acceleration is given when the rollers R1, R2, . . . of the index plate 11 have just started or completed guided movement in the sine-curved groove section on the barrel cam 4, that is to say, when the driving feed roll 16 has just started or completed its rotation.

3. In the case of the double-grooved barrel cam, one of the rollers R1, R2, . . . is kept engaged in the groove even when the index plate 11 is driven, so that positive motion is provided.

4. The time permitted for the feed is not restricted to ½ period as in the conventional devices, but can span over ¾ period and also the required advance, that is, the feed starting and terminating time can be adjusted to the cutting position in timed relation with the contact of the punch with the material, so that even if unforeseen disturbance should be given, such disturbance can be absorbed before contact of the punch with the material.

For these reasons, no unnecessary inertia is given either to the driving and driven feed rolls 16 and 18, or to the material M, so that both driving and driven feed rolls 16 and 18 are turned correctly as scheduled and the turning motion of said rolls 16 and 18 is transmitted accurately to the material M, thus allowing perfect maintenance of constant material feed accuracy.

This proves even more significant in the case of high-speed feed. With the conventional systems, high speed press work has been hardly possible as there was a certain limitation on speed-up for automatic feed of material although speed-up of the press itself was possible. The present invention can overcome such a problem. Also, according to the present invention, the material utilization rate is improved owing to constant high feed accuracy. Also noise and shaking are minimized owing to employment of a rotary mechanism for the motion transmission system to permit smooth and quiet operation. Further, since there are provided no reciprocation - circular motion converting means and few joints, there is left little room for occur backlash. As viewed above, the present invention is characterized particularly by the fact that a motion transmission mechanism using a barrel cam as a principal element is adapted for the automatic material feeder device, not in an ordinary machine tool which involves little chance of momentarily developing any excess force, but rather in a press machine where there is much chance of encountering instantaneous excess force and for which high rigidity or kinetic precision is required.

In the foregoing embodiment, the roll feed mechanism B is detachably set to the motion transmission mechanism A. This arrangement has the advantage that the roll feed mechanism B having the driving feed roll 16 with any of a wide variety of diameters can be exchanged according to the press working requirements. In other words, the motion transmission mechanism A having an index plate 11 equally sectioned circumferentially in various ways can be exchanged in accordance with the press working pattern.

The pitch of feed of material can be determined from the following formula (1):

$$P\ m/m = \pi D\ m/m/N\ . \qquad (1)$$

where $P$ = pitch of feed of material, $D$ = diameter of feed roller, $N$ = number of indexed of the index plate 11. Therefore, it is possible to adjust the pitch of feed of the material by changing the diameter D of the driving feed roll 16 or the number of indexes N of the index plate 11 or by suitably rearranging them, thus allowing immediate conformity to the press working conditions at the moment. In other words, it is possible to immediately and optimally select the pitch of feed of the workpiece corresponding to the press working requirements and to utilize the press working formula for wide versatility in material feed.

Referring now to FIGS. 5 to 9 of the accompanying drawings, there will now be described in detail another embodiment of the present invention which incorporates further improvements over the above-described embodiment. Such improvements comprise a material releasing means and a brake means. This embodiment is otherwise substantially the same as the preceding one.

First, the material releasing means will be described. A lift cam driving shaft 35 is rotatably supported by bearings 36, 37, 38 and 39 in the casing 1 such that said lift cam driving shaft extends perpendicular to said main driving shaft 2, and parallel to the driving shaft 9. This lift cam driving shaft 35 has mounted thereon for rotation therewith, a gear 40 which is meashed with a gear 41 mounted on said main driving shaft 2 so that the rotative force of said driving shaft 2 is transmitted to said lift cam driving shaft 35. At the distal end of said shaft is mounted a lift cam 42 arranged for adjustment in its setting angle by means of a span ring 43 and a fitment 44. Of course the way of mounting this lift cam 42 is not restricted to the one just described, it is also possible, although not shown, to mount such lift cam adjustably in its setting angle by using a coupling and nut combination. Or any other method may be employed so that the lift cam 42 can be mounted adjustably in its setting angle on the lift cam driving shaft 35 so as to allow the desired timing adjustment.

Substantially L-shaped levers 45 (only one of which is shown and described below in association with roll holder **20*b*, but the other of which is in similar association with roll holder 20*a*) are each pivoted by a fulcrum 46 and biased by a spring 47 to turn in the direction of said lift cam 42 so that the roller 48 carried at the end of the lower portion 45' of said lever 45 is always in pressing engagement with the lift cam 42. The upper portion 45'' of said lever 45 abuts against a roller 53 rotatably pivoted by a pin 52 to the distal end of the lower end portion 51' of a substantially L-shaped lever 51 pivotally secured by a pivotal pin 49 and a bush 50. The upper portion 51'' of said lever 51 terminates in a roll holder 20*b*. That is, the upper portions of the respective levers 51 constitue the roll holders 20*a* and 20*b***, respectively.

A manual lever 54 projects outside of the unit casing 13. Directly joined to said lever 54 is a metal rod 55 formed with a cam 56 disposed in opposition to a bearer 57 provided on the roll holder **20*a*, 20*b***.

Also, in the drawings, reference numral 58 designates a tubular boss of the index plate 11, 59 a ring adapted to control positioning of the index plate 11 in cooperation with said boss 58, 60 an oil seal provided on the side of the bearing **10*b*, 61 an inner cover adapted to hold the bearing 10*a* in position, 62 an outer cover disposed over said inner cover, 63 an oil seal disposed in said outer cover, 64 a cover provided for protecting the bearings 36, 37 of the lift cam driving shaft 35, 65 a bearing case for the bearings 3*b*, 3*c* of the main driving shaft 2, and 67 an oil seal. These members are adapted to eventually serve for preventing leak of the lubricant supplied from a lubricant inlet 68 formed in the top of the casing 1** and for protecting the interior mechanism against dust.

Numeral 69 designates an inner cover arranged to be opened when joining or disjoining the casing 1 of the motion transmission mechanism A and the unit casing 13 of the roll feed mechanism B, 70 an oil seal provided in said inner cover, 71 an outer cover of the unit casing 13, 72 a locking fitment for the main driving shaft 2, and 73 a locking fitment for the lift cam driving shaft 35.

Figure 8:
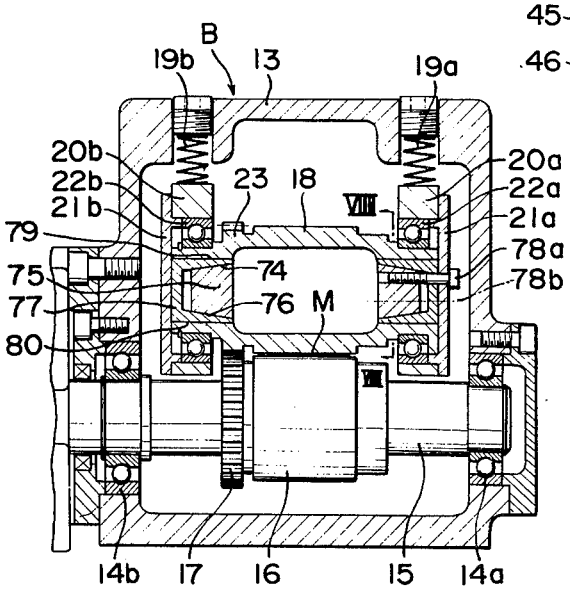
FIG. 8 is an enlarged sectional view showing the arrangement of the brake means in the driven feed roll.
Figure 9:
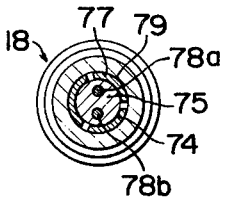
FIG. 9 is a sectional view taken along the line 9—9 of FIG. 8.

The mechanism of the brake means incorporated with the driven feed roll 18 is described below with reference to FIGS. 8 and 9. The driven feed roll 18 is formed from a hollow cylinder and provided at both ends thereof with brake drums 77 each of which has an internal conically-shaped opening 76 in section and contains a pressing member 75 which is externally conically-shaped as defined by surface 74. The pressing member 75 an brake drum 77 are joined so as to be adjustable in snugness of fit by means of screws **78*a*, 78*b* adapted from the caps 21*a* and 21*b* sides although only the screws on the 21*a* side are shown. Thus, friction between the externally conically-shaped portion 74 of the pressing member 75 and the internal conically-shaped opening 76 of the brake drum 77 is adjusted by regulating the extent of fitting of the screws 78*a*, 78*b* thereby to adjust friction between the external surface 79 o the brake drum 77 and the internal surface 80 of the hollow driven feed roll 18, so as to control the damping action of said driven feed roll 18** through such adjustment of friction.

Operation of the releasing and braking actions of the above-described releasing and brake means as adapted in this embodiment are described below. In accordance with a turn of the crank shaft of the press from 0° to 90° and thence to 180° and corresponding advancement of the cope **34*a*** through the course of *a-b-b'-c*, the main driving shaft 2 is turned to cause a corresponding turn of the lift cam shaft 35, and hence, the lift cam 42, through the gears 41 and 40. In this case, the relation between the angle of turn of the crank shaft and that of the lift cam 42 is such that the lift cam 42 will make a turn with one rotation of the crank shaft. The timing of lift cam 42 and the crank shaft is regulated such that when the crank shaft is turning though the section 90° – 180°, the lift cam 42 moves the L-shaped lever 45, so that immediately before the pilot punch **34*c* contacts material M, the lift cam 42 is set at the position of FIG. 7 and subsequently displaces the lever 45 clockwise against the tension of the spring 47 to press the lower portion 51' of the lever 51 by the upper portion 45'' of the lever 45, causing the roll holers 20*a*, 20*b* and hence the driven feed roll 18 to move upwardly, whereby the material M set stationary between the driving feed roll 16 and driven roll 18 is brought into a free state and perfectly fixed at the regulated position by the pilot punch 34*c***.

Figure 7:
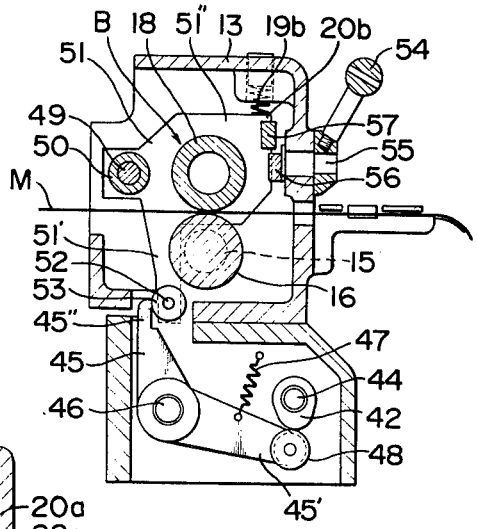
FIG. 7 is a sectional view taken along the line $7\text{-}0_3\text{-}0_4\text{-}7$ of FIG. 5.

As the crank shaft of the press further turns from 180° to 270° and then to 360° while the cope **34*a*** of the press ascends through the course of *c-c'-d-a*, the lift cam 42 is forced to turn about 180° from the position of FIG. 7, causing the lever 45 to turn counterclockwise owing to the tension of the spring 47 to release pressure on the lower portion 51' of the lever 51 causing the roll holders **20*a*, 20*b* to move downwardly by pressure of springs 19*a*, 19*b*, whereby the gear 17 on the main driving feed roll 16 is meshed with the gear 23 on the driven feed roll 18 to bring the material M to the position where it is frictionally held between the driving feed roll 16 and the driven feed roll 18**.

Therefore, there is produced no impediment to feeding of the material M which is effected by turning the crank shaft from 270° to 360° while correspondingly turning the index plate 11 by the barrel cam 4. In short, timing is set such that the driven feed roll 18 is released only during contact of the punch **34*c*** with material M, that is, only when it is required to stop movement of the material M.

When the crank shaft of the press is positioned at 360° and the index plate 11 which had been turned by the barrel cam 4 has stopped turning, that is, when both driving and driven feed rolls 16 and 18 have stopped rotating and the feed of the material M has just ended, the driven feed roll 18 may continue to rotate due to inertia force, but as friction develops between the external surface of the brake drum 77 in said roll 18 and the internal surface 80 of the hollow driven roll 18, said roll 18 is perfectly braked to a stop. As mentioned above, since a barrel cam 4 having the sine wave motion characteristic is employed as the mechanism for transmitting motion from the press body to the driving feed roll, this arrangement alone can ensure perfect feed performance, but the present invention is further incorporated with a releasing means for correctly positioning the material M and a brake means for stopping rotation of the driven feed roll 18 due to inertia so that even more positive and accurate feed is accomplished and there is left absolutely no room for giving rise to a feed error even in high speed feed.

Figure 10:
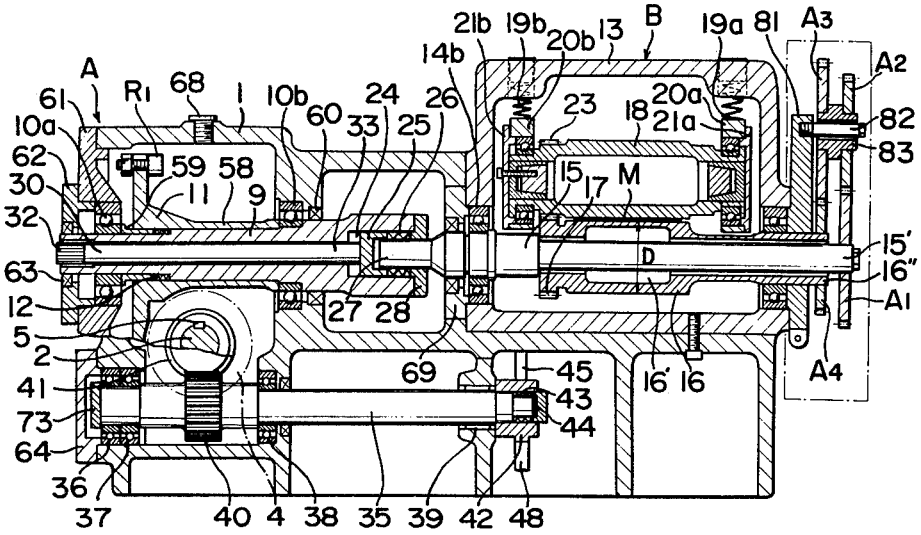
FIG. 10 is a longitudinal sectional view of a third embodiment of the present invention.
Figure 11:
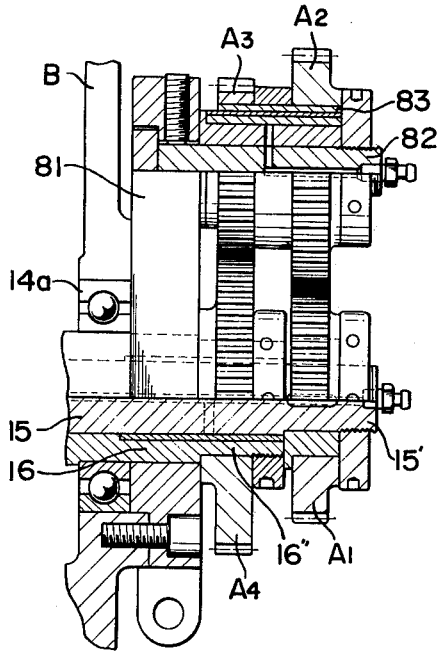
FIG. 11 is a side sectional view of the embodiment of FIG. 10 showing the change gear unit on an enlarged scale.

Another embodiment of the present invention incorporating additional improvements on the first and second embodiments discussed previously, is described in detail below with reference to FIGS. 10 and 11 of the accompanying drawings. This embodiment is substantially the same as the preceding embodiments except for provision of a feed pitch adjusting means constitued by a change gear means. The driving feed roll 16 is not directly secured to the driving feed roll shaft 15 as was the case in the previous embodiments but instead the latter is passed through the hollow portion 16' of the driving roll 16 and a gear A1 is mounted at an end 15' of said shaft 15. A gear A4 is also mounted at an end 16'' of the driving feed roll 16. Also, a holder 81 is provided to the unit casing 13 of the roll feed mechanism B, and a shaft 82 is secured to said holder 81, with a gear support 83 being rotatably arranged on said shaft 82. Mounted on said gear support 83 are a gear A2 arranged to mesh with the gear A1 and a gear A3 arranged to mesh with the gear A4 so that the torque of rotation of said driving feed roll shaft 15 will be transmitted to the driving feed roll 16 through said gears A1, A2, A3 and A4 in that order. What is particularly important in this arrangement is that all of said gears A1, A2, A3, and A4 are change gears which can be exchanged by an external operation, and so a series of gears with various tooth numbers are prepared beforehand and they are exchanged by an extremely simple external operation when it is desired to adjust the feed pitch according to the change of the press working conditions. FIG. 11 diagrammatically shows an example of such gear exchanging mechanism embodying the principle shown in FIG. 10. According to this arrangement, the pitch of feed of material is calculated from the following formula (2) which is a modified version of the aforesaid formula (1), $P\ m/m = \pi\ D\ m/m/N$, which is hereinafter referred to as the standard pitch of feed:

$$P'\ m/m = P\ m/m \times A1/A2 \times A3/A4 \qquad (2)$$

where

P' = required pitch of feed of material M;

P = standard pitch of feed; and

A1, A2, A3 and A4 = gears with different tooth numbers.

Thus even in the case the number of indexes N of the index plate 11 and the diameter D of the main driving feed roll 16 are constant, it is possible to obtain the pitch of feed of material that exactly conforms to the change of the working conditions by merely selecting or changing the A1/A2 and A3/A4 ratios of said gears A1, A2, A3 and A4.

An example is shown hereinbelow:

1. It is assumed that the number of indexes N of the index plate 11 and the diameter D of the driving feed roll 16 are given as constant and that the standard pitch P of feed of the material as calculated from the formula (1) was 12.5 m/m.

2. It is also assumed that, in this case, the pitch of feed of the material was set at 3 m/m corresponding to the change of the press working conditions.

3. This requirement can be met by selecting the gears A1, A2, A3 and A4 with tooth numbers of 38, 82, 41 and 79 respectively. The pitch of feed can be determined from the formula (2) as follows:

$$12.5\ m/m \times (38/82) \times 41/79) = 3.009\ m/m$$

4. The pitch of feed of the material M thus calculated from the formula (2) is 3.009 m/m. Comparing this value with the required feed pitch 3 m/m, it is noted that the difference is merely 0.009 m/m. This value itself is insignificantly small, but When it is considered in terms of feed error, it is further divided by the number of indexes N of the index plate 11, so that it is even more reduced to become an infinitesimal value. It is thus possible to easily and readily obtain the required pitch of feed of the material M while perfectly maintaining the feed accuracy.

5. The foregoing is merely an example. It will be apparent that the required pitch of feed of the material M can be obtained over a wider range by suitably changing the relative gear ratios A1/A2 and A3/A4.

Thus, according to this embodiment of the present invention, it is possible to easily adjust the pitch of feed of the material according to the change of the working and/or operating conditions, and particularly, such adjustment of the pitch of feed can be affected over a wide range by a simple external operation, and hence there is provided a roll feeder device of a barrel cam driving system having a wide range of selection for the pitch of feed. Further, even if such pitch of feed is selected freely over a wide range, the feed accuracy can be constantly maintained at high level.

Although the foregoing description illustrates the preferred embodiments of the present invention, it will be apparent to those skilled in the art that variations are possible. All such variations as would be obvious to those skilled in this art are intended to be included within the scope of this invention as defined by the following claims.

What is claimed is:

1. A roller-type feed device for press works, comprising:

a roll feed mechanism having a driving feed roll means, a driven feed roll means, gear means drivingly connecting the driving feed roll means to the driven feed roll means, the driving feed roll means and the driven feed roll means being in spaced relation such that they will frictionally engage a material to be fed between them and feed the same due to rotation of the driving and driven feed roll means;

a motion transmission mechanism having
a main drive shaft associated with and driven by a crank shaft in the press works,
a barrel cam mounted on the main drive shaft for rotation therewith,
an index means mounted for rotation and in driven engagement with the barrel cam,
the barrel cam having at least one groove in the surface thereof a portion of which is a sine-curve groove such that will produce constant velocity rotation of the index means and another portion of which is a rectilinear groove such that will produce no rotational motion of the index means;
the driven feed roll means of the roll feed mechanism being in driven engagement with the index means whereby movement of the index means causes movement of the driving feed roll means so as to feed the material between the driving feed roll means and the driven feed roll means at predetermined intervals;
the driving feed roll means including:
a driving feed roll shaft mounted for axial rotation,
a driving feed roll mounted on the driving feed roll shaft for rotation therewith;
the driven feed roll means includes:
a driven feed roll mounted for axial rotation and for axial translation in a plane containing the axis of the driving feed roll shaft,
spring means biasing the driven feed roll towards the driving feed roll;
the gear means includes:
a driving gear secured to the driving feed roll shaft for rotation therewith,
a driven gear secured to the driven feed roll and in driven engagement with the driving gear;
the main drive shaft is connected to the press works drive shaft through an endless belt means;
the index means includes:
a circular index plate mounted for rotation about the central axis thereof,
a plurality of rollers mounted on one side of the index plate equidistant from the axis of rotation thereof and engageble with the grooves in the barrel cam;
the index plate being connected to the driving feed roll shaft so as to cause rotation thereof when the index plate is rotated by the barrel cam.

2. A roller-type feed device for press works, comprising:
a roll feed mechanism having
a driving feed roll means,
a driven feed roll means,
gear means drivingly connecting the driving feed roll means to the driven feed roll means,
the driving feed roll means and the driven feed roll means being in spaced relation such that they will frictionally engage a material to be fed between them and feed the same due to rotation of the driving and driven feed roll means;
a motion transmission mechanism having
a main drive shaft associated with and driven by a crank shaft in the press works,
a barrel cam mounted on the main drive shaft for rotation therewith,
an index means mounted for rotation and in driven engagement with the barrel cam,
the barrel cam having at least one groove in the surface thereof a portion of which is a sine-curve groove such that will produce constant velocity rotation of the index means and another portion of which is a rectilinear groove such that will produce no rotational motion of the index means;
the driven feed roll means of the roll feed mechanism being in driven engagement with the index means whereby movement of the index means causes movement of the driving feed roll means so as to feed the material between the driving feed roll means and the driven feed roll means at predetermined intervals;
the driven feed roll being formed of a hollow cylinder and provided at both ends thereof with internal conically-shaped brake drums;
externally conically-shaped brake members mounted within and mating with the internal conically-shaped brake drums;
screw means for adjusting the degree of joinder between the brake members and the brake drums;
a lifting cam driving shaft mounted for rotation in a plane perpendicular to the main drive shaft;
lifting cam gear means secured to the main drive shaft and the lifting cam driving shaft to impart rotational movement from the main drive shaft to the lifting cam drive shaft;
a lifting cam mounted for rotation on the lifting cam driving shaft and having an eccentric outer surface portion;
lever means operatively connected to the driven feed roll means and having an end portion biased against the outer surface of the lifting cam, for causing movement of the driven feed roll away from the driving feed roll so as to disengage the gear means and stop the feed of the material in response to movement of the end portion of the lever means over the eccentric outer surface portion of the lifting cam.

3. A roller-type feed device for press works, comprising:
a roll feed mechanism having
a driving feed roll means,
a driven feed roll means,
gear means drivingly connecting the driving feed roll means to the driven feed roll means,
the driving feed roll means and the driven feed roll means being in spaced relation such that they will frictionally engage a material to be fed between them and feed the same due to rotation of the driving and driven feed roll means;
a motion transmission mechanism having
a main drive shaft associated with and driven by a crank shaft in the press works,
a barrel cam mounted on the main drive shaft for rotation therewith,
an index means mounted for rotation and in driven engagement with the barrel cam,
the barrel cam having at least one groove in the surface thereof a portion of which is a sine-curve groove such that will produce constant velocity rotation of the index means and another portion of which is a rectilinear groove such that will produce no rotational motion of the index means;
the driven feed roll means of the roll feed mechanism being in driven engagement with the index means whereby movement of the index means causes movement of the driving feed roll means so as to feed the material between the driving feed roll means and the driven feed roll means at predetermined intervals;

the index means including:

a roll driving shaft disposed substantially perpendicular to the main drive shaft, a circular index plate mounted on one end portion of the roll driving shaft for rotation therewith, the roll driving shaft being formed of a hollow cylinder with another end portion having a larger internal diameter than the one end portion, an end of the driving feed roll shaft being fitted within the larger diameter end portion;

a collar and span ring also being fitted within the larger diameter end portion concentrically with the end of the driving feed roll shaft;

a set screw and bearing plate mounted on the end of the larger diameter end portion so as to contain the collar and span ring; and a mandrel fitted in the one end portion of the roll driving shaft and extending therethrough so as to be in contact with the collar and biasing the collar against the span ring and bearing plate so as to detachably join the roll driving shaft and the driving feed roll shaft.

4. A roller-type feed device for press works, comprising:

a roll feed mechanism having a driving feed roll means, a driven feed roll means, gear means drivingly connecting the driving feed roll means to the driven feed roll means, the driving feed roll means and the driven feed roll means being in spaced relation such that they will frictionally engage a material to be fed between them and feed the same due to rotation of the driving and driven feed roll means;

a motion transmission mechanism having a main drive shaft associated with and driven by a crank shaft in the press works, a barrel cam mounted on the main drive shaft for rotation therewith, an index means mounted for rotation and in driven engagement with the barrel cam, the barrel cam having at least one groove in the surface thereof a portion of which is a sine-curve groove such that will produce constant velocity rotation of the index means and another portion of which is a rectilinear groove such that will produce no rotational motion of the index means;

the driven feed roll means of the roll feed mechanism being in driven engagement with the index means whereby movement of the index means causes movement of the driving feed roll means so as to feed the material between the driving feed roll means and the driven feed roll means at predetermined intervals;

the driving feed roll being a hollow cylinder, a driving feed roll shaft being passed through the driving feed roll and supported for independent rotation from the driving feed roll, change gear means having a plurality of interengaging gears interconnecting the driving feed roll shaft to the driving feed roll so as to permit a change in the speed ratio of the driving feed roll shaft and the driving feed roll by a change in gears.

* * * * *